US010961991B2

(12) United States Patent
Achten

(10) Patent No.: US 10,961,991 B2
(45) Date of Patent: Mar. 30, 2021

(54) HYDRAULIC SWASH BLOCK POSITIONING SYSTEM

(71) Applicant: Innas B.V., Breda (NL)

(72) Inventor: Peter Augustinus Johannes Achten, Eindhoven (NL)

(73) Assignee: Innas B.V.

( * ) Notice: Subject to any disclaimer, the term of this patent is extended or adjusted under 35 U.S.C. 154(b) by 571 days.

(21) Appl. No.: 14/768,147

(22) PCT Filed: Feb. 11, 2014

(86) PCT No.: PCT/EP2014/052638
§ 371 (c)(1),
(2) Date: Aug. 14, 2015

(87) PCT Pub. No.: WO2014/128024
PCT Pub. Date: Aug. 28, 2014

(65) Prior Publication Data

US 2015/0377223 A1 Dec. 31, 2015

(30) Foreign Application Priority Data

Feb. 19, 2013 (EP) ..... 13155807

(51) Int. Cl.
*F04B 1/324* (2020.01)
*F04B 49/00* (2006.01)
(Continued)

(52) U.S. Cl.
CPC ..... *F04B 1/324* (2013.01); *F04B 1/20* (2013.01); *F04B 1/22* (2013.01); *F04B 49/002* (2013.01); *F04B 49/12* (2013.01)

(58) Field of Classification Search
CPC .. F04B 1/324; F04B 1/30; F04B 1/306; F04B 1/32; F04B 1/322; F04B 1/20; F04B 1/22; F04B 49/002; F04B 49/12
See application file for complete search history.

(56) References Cited

U.S. PATENT DOCUMENTS 6,413,055 B1 7/2002 Geringer et al.
2003/0097927 A1 5/2003 Boone
2005/0123412 A1* 6/2005 Shimizu ..... F01B 3/0035 417/269

FOREIGN PATENT DOCUMENTS

CN 1369650 A 9/2002
CN 1421606 A 6/2003
(Continued)

OTHER PUBLICATIONS

International Search Report and Written Opinion Application No. EP 2014 052638 Completed: Jun. 10, 2014; dated Jul. 21, 2014 7 pages.

*Primary Examiner* — Alexander B Comley
(74) *Attorney, Agent, or Firm* — St. Onge Steward Johnston & Reens LLC

(57) ABSTRACT

A hydraulic swash block positioning system for positioning a swash block to set a variable displacement, the hydraulic device including a rotor with pistons and piston chambers, the positioning system having, between the housing and the swash block, a positioning cylinder with a positioning piston forming a positioning chamber for setting an average value of the swash block position and a control valve connecting the high oil pressure source with the positioning chamber through a feeding line. In accordance with the invention the feeding line is connected to an oil container that has a variable container volume that can be adjusted synchronously with the changes in the number of piston chambers connected to the high oil pressure source.

13 Claims, 16 Drawing Sheets

(51) Int. Cl.

| | |
|---|---|
| ***F04B 1/20*** | (2020.01) |
| ***F04B 1/22*** | (2006.01) |
| ***F04B 49/12*** | (2006.01) |

(56) References Cited

FOREIGN PATENT DOCUMENTS

| | | | | | |
|---|---|---|---|---|---|
| DE | 2347542 | A1 | | 3/1975 | |
| DE | 19919160 | A1 | | 11/1999 | |
| DE | 102008061828 | A1 | | 6/2010 | |
| DE | 102011105544 | A1 | * | 1/2012 | ..... F04B 27/22 |
| DE | 102011105544 | A1 | | 1/2012 | |
| DE | 102010053804 | A1 | * | 6/2012 | ..... F04B 1/20 |
| DE | 102010054415 | A1 | | 6/2012 | |
| DE | 102011109598 | A1 | | 2/2013 | |
| EP | 0273214 | A2 | | 7/1988 | |
| EP | 1013927 | A2 | | 6/2000 | |
| EP | 1705372 | A1 | * | 9/2006 | ..... F04B 1/2007 |
| JP | S5783676 | A | | 5/1982 | |
| JP | H06159252 | A | | 6/1994 | |
| WO | 2012050446 | A1 | | 4/2012 | |
| WO | 2014128024 | A1 | | 8/2014 | |

* cited by examiner

HYDRAULIC SWASH BLOCK POSITIONING SYSTEM

FIELD OF THE INVENTION

The invention concerns a hydraulic swash block positioning system for positioning a swash block.

BACKGROUND OF THE INVENTION

An example of a pump with such a system is a Variable Displacement Pump 101 as illustrated in FIG. 1. The control valve 105 can change the oil flow through a control flow line 106 and flow restriction 107 thereby changing the oil pressure in the feeding line 112 so that the average position of the swash block position around the swash block axis changes.

The piston chambers are connected via a high pressure port in a valve plate with the high oil pressure source 104 or a low pressure port in the valve plate with the low pressure source 103. The piston chambers connected to the high oil pressure source 104 exert a resultant force on the swash block. Rotation of the rotor changes the length of an arm between the swash block axis and the resultant force. Furthermore, a piston chamber passing a transition between the high pressure port and the low pressure port changes the pressure in the piston chamber. This influences the resultant force on the swash block and its position. This means that all piston chambers together create a swivel torque on the swash block around the swash block axis that oscillates with an oscillation frequency that is equal to the number of piston chambers that rotate along the swash block times the number of full rotations of the rotor per second. This oscillating swivel torque causes the swash block to oscillate around the swash block axis.

In the prior art, there is a compensation cylinder with a compensation piston forming a compensation chamber that is connected to the high pressure source and has an oil flow to and from the compensation chamber without any obstruction and the pressure in the compensation chamber does not influence the oscillation of the swash block. The oil to and from the positioning chamber 102 cannot flow freely as the oil pressure in the feeding line 112 determines the average setting of the swash block position. The oil pressure in the feeding line 112 depends on the inflow through the control valve 105 and the outflow through the flow restriction 107 since the feeding line 112 is connected to the control flow line 106 between the control valve 105 and the flow restriction 107.

In the pump according to the prior art, the control valve 105 is open and there is an oil flow from the high oil pressure source 104 through the control valve 105 and through the flow restriction 107 to a drain that is connected to the low pressure source 103. If the swash block would not oscillate and the volume of the positioning chamber 102 would not change the opening of the control valve 105 and the flow restriction 107 would determine the more or less constant pressure in the positioning chamber 102. The setting of the control valve 105 is controlled by a load sensing system and the control valve 105 has approximately a constant setting when compared to the oscillation frequency of the swash block.

However, as described earlier, the swash block oscillates and therefore the positioning chamber 102 has a variable volume. The variable volume of the positioning chamber 102 caused by the oscillating swash block leads to compression and expansion of the oil volume in the positioning chamber 102, the feeding line 112 and the control flow line 106 and to an oscillating oil pressure. This oscillating oil pressure leads to variable oil flows through the control valve 105 in the feeding line 112 and through the flow restriction 107 out of the feeding line 112 whereby the resulting average oil pressure in the feeding line 112 ensures an average swash block position. These average values remain more or less independent of the rotation speed of the pump and of the oscillation frequency.

SUMMARY OF THE INVENTION

In order to prevent that expansion and compression of the oil caused by the oscillation of the swash block leads to extreme low and/or high oil pressure in the feeding line 112 and remains within acceptable values, the connection to the high oil pressure source 104 through the control valve 105 must be sufficiently open and the flow restriction 107 therefore must also be sufficiently open causing a considerable oil flow to the drain and the low pressure source 103. The disadvantage in the design according to the prior art is that the oil flow of high pressure oil through the control valve 105 and the flow restriction 107 to the low pressure source 103 leads to considerable loss of high pressure oil and therefore to reduced hydraulic efficiency. In order to overcome this disadvantage the hydraulic swash block positioning system has a feeding line connected to an oil container (19, 33, 55) that has a variable container volume and the oil container has an adjuster for adjusting the variable container volume synchronously with the changes in the number of piston chambers connected to the high oil pressure source (54) and wherein in the feeding line between the positioning chamber and the oil container might have a flow restriction (57).

In this way, changes in the volume of the position chamber due to oscillations of the swash block are compensated by changes in the variable container volume and too low oil pressure and/or too high oil pressure in the feeding line is/are avoided. The flow restriction can create pressure variation in the positioning chamber to damp the swash block oscillations that are caused by the oscillating torque on the swash block.

In accordance with another embodiment the hydraulic swash block positioning system has two swash blocks with synchronously rotating piston chambers and during rotor rotation a piston chamber of the first swash block and a piston chamber of the second swash block alternating connect to the high oil pressure source and wherein the first swash block has a first positioning chamber and the second swash block has a similar second positioning chamber and a feeding line (20) connects the first positioning chamber with the second positioning chamber. In this way, the second positioning chamber acts as the variable container volume for the first positioning chamber and vice versa. The combined oil volumes in both positioning chambers and the feeding lines remains more or less constant so that compression and expansion of the oil volumes are reduced and pressure extremes are reduced.

It is noted that in case of two swash blocks the oscillating torques on the swash blocks are in counter phase and as the positioning chambers have a similar design the volumes of the positioning chambers are in counter phase as well.

In accordance with another embodiment the hydraulic swash block positioning system has piston chambers that cooperate with the first swash block and the second swash block are mounted on a combined rotor between the swash blocks and the first and second swash block might be symmetric relative a plane perpendicular to a rotor rotation axis. In this way, the hydraulic device has a compact design with a single housing that includes the canals for positioning the swash blocks; the symmetric design causes the swash blocks to oscillate in opposite directions so that the combined oscillation is strongly reduced and vibrations on the foundation are avoided.

In accordance with another embodiment the hydraulic swash block positioning system has a control flow line (51) that connects the control valve (52) to the feeding line(s) (20) and to the low oil pressure source (53) via a downstream restriction (56). In this way, there is a small uninterrupted oil flow through the lines connecting the positioning chambers and heat build-up in the oscillating oil volume in the positioning chambers is avoided.

In accordance with another embodiment the hydraulic swash block positioning system first positioning chamber connects via a first feeding line (20) that might have a first flow restriction (57) to a first side of a flow limiter (55) with a movable separation wall (58) and the second positioning chamber connects via a second feeding line (20) that might have a second flow restriction to the flow limiter at a second side of the movable separation wall, wherein a line with a flow limiter restriction (59) connects the first feeding line and the second feeding line. In this way, the oil flow from the first positioning chamber to the second positioning piston encounters none or a small flow resistance for a first flow volume so that small oscillations that occur at higher frequencies experience little resistance. For larger oscillations that occur at lower oscillation frequencies there is after a limited flow an increased flow resistance. This allows sufficient oil flow for larger oscillating movements up to defined displacement and above that the oscillating movement experiences resistance so that overshoot that occurs at low oscillating frequencies is avoided.

In accordance with another embodiment the hydraulic swash block positioning system control valve is a hydraulic servo valve with a spool controlled by the average oil pressure in the positioning chamber and a control pressure depending on a desired change in the average value of the swash block position and wherein there is a separate hydraulic servo valve for each swash block. In this way, the control valve can be integrated in a hydraulic control system and/or the housing in an easy way.

In accordance with another embodiment the hydraulic swash block positioning system control pressure acts on an actuator pin with a limited stroke that pushes against the spool, and wherein the spool is mounted in the swash block and the actuator pin in the housing or vice versa. In this way, the maximum and minimum swash block angle can be controlled hydraulically, thereby avoiding additional forces on swash block bearings caused by a hard stop of the swash block against the housing.

In accordance with another embodiment the hydraulic swash block positioning system adjuster for adjusting the variable container volume varies the volume of the oil container proportionally to the actual oil pressure in the positioning chamber. This means that when the oil pressure in the positioning chamber increases the volume of the oil container is increased synchronously by means of the oil container volume adjusting member. This avoids excessive pressure rise in the feeding line. In case the oil pressure in the positioning piston decreases the volume of the oil container is decreased synchronously in order to transfer oil from the oil container to the positioning piston. This avoids a too low pressure in the feeding line and therefore minimizes the risk of cavitations.

In accordance with another embodiment the hydraulic swash block positioning system maximum displacement valve (70) has a sensor that detects approaching a first predefined swash block position and the maximum displacement valve (70) connects the positioning chamber (19, 33) to the low oil pressure source (53) or the high oil pressure source (54) upon reaching the predefined swash block position. In this way, the pressure in the positioning chamber changes abruptly when the swash block position reaches the first predetermined swash block position and the further movement stops independent of the settings of the control valve and the maximum displacement valve prevents damage.

In accordance with another embodiment the hydraulic swash block positioning system positioning cylinder (14) is provided with a spill opening (73) which opens upon reaching a second predefined swash block position so as to create a second limit for the swash block position. In this way, the pressure in the positioning chamber changes abruptly when the swash block position reaches the second predetermined swash block position and the further movement stops independent of the settings of the control valve and the spill opening prevents damage.

In accordance with another embodiment the hydraulic swash block positioning system positioning cylinder (14) is mounted on the swash block (8) around the positioning piston (18), wherein the spill opening is formed by a recess (73) which is located remote from the swash block (8) at an axial end portion of the internal wall of the positioning cylinder (14).

BRIEF DESCRIPTION OF THE DRAWINGS

The invention is explained below with reference to embodiments and with the aid of drawings.

DETAILED DESCRIPTION OF THE INVENTION

Figure 1:
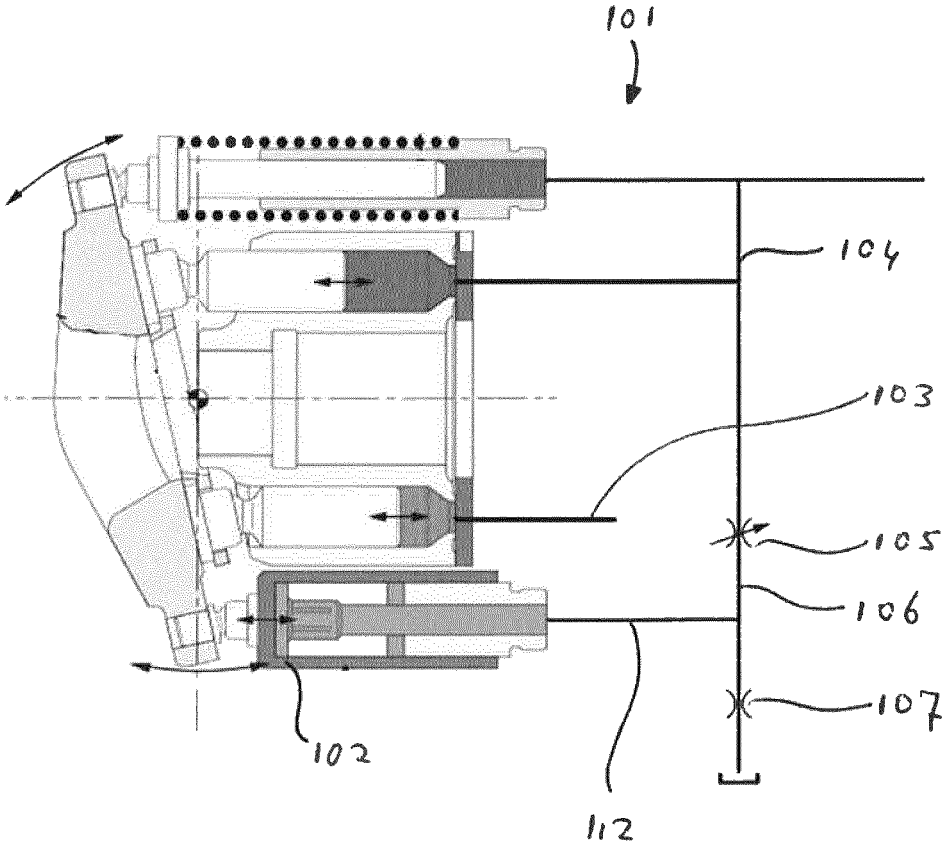
FIG. 1 is a schematic view of a prior art variable displacement pump including its control system.

FIG. 1 shows a prior art variable displacement pump 101 and its control system in a schematic way.

The prior art pump 101 comprises a rotor with pistons and piston chambers with a variable stroke volume. The pump 101 is provided with a swash block that can rotate around a swash block axis to a swash block angle to set a stroke volume. A hydraulic control system of the pump 101 comprises a hydraulic swash block positioning piston with a positioning chamber 102 for setting the swash block angle. The piston chambers 102 of the pump 101 are alternating connected via a valve plate to a low oil pressure source 103 and a high oil pressure source 104.

The positioning chamber 102 is controlled by a control valve 105 which dictates the oil flow through a control flow line 106 and a possibly variable restriction 107 to the low pressure source 103. This results in a certain pressure level in a feeding line 112 to the positioning chamber 102. In a static situation in which the rotor does not rotate the pressure in the feeding line 112 has a constant value and is dictated by the setting of the control valve 105 and the restriction 107.

If the control valve 105 is adjusted to a condition of a higher flow through the control flow line 106 a higher oil pressure is created in the feeding line 112 and the positioning chamber 102. This means that the swash block of the pump 101 will be rotated to a condition of a smaller stroke volume and a smaller pump displacement.

In a theoretical situation wherein the swash block would not oscillate around the swash block rotation axis, the settings of the control valve 105 and the flow restriction 107 would dictate the more or less constant pressure in the positioning chamber 102 and the feeding line 112. However, there is an oscillating torque load on the swash block and the swash block oscillates in practice at a high frequency and therefore the positioning chamber 102 has a variable volume and only the feeding line 112 can supply oil to this variable volume. If the flow to the positioning chamber 102 is too small the resulting under pressure in the positioning chamber 102 might lead to cavitations and damage. In order to prevent this, the flow through the control valve 105 must be sufficient to provide sufficient oil flow to the positioning chamber 102 and changing the setting of the control valve 105 is not possible at the frequency required to follow the oscillations of the swash block so the setting of the control valve 105 must be at a relatively large opening. In order to set the pressure at a specific value in the control flow line 106, the large opening in the control valve 105 requires the flow through the restriction 107 to be sufficient too, so that a considerable oil flow through the control valve 105 and the restriction 107 is required to prevent cavitations in the positioning chamber 102.

The resulting oil flows through the control valve 105 and the flow restriction 107 leads to relatively high flow losses.

Figure 2:
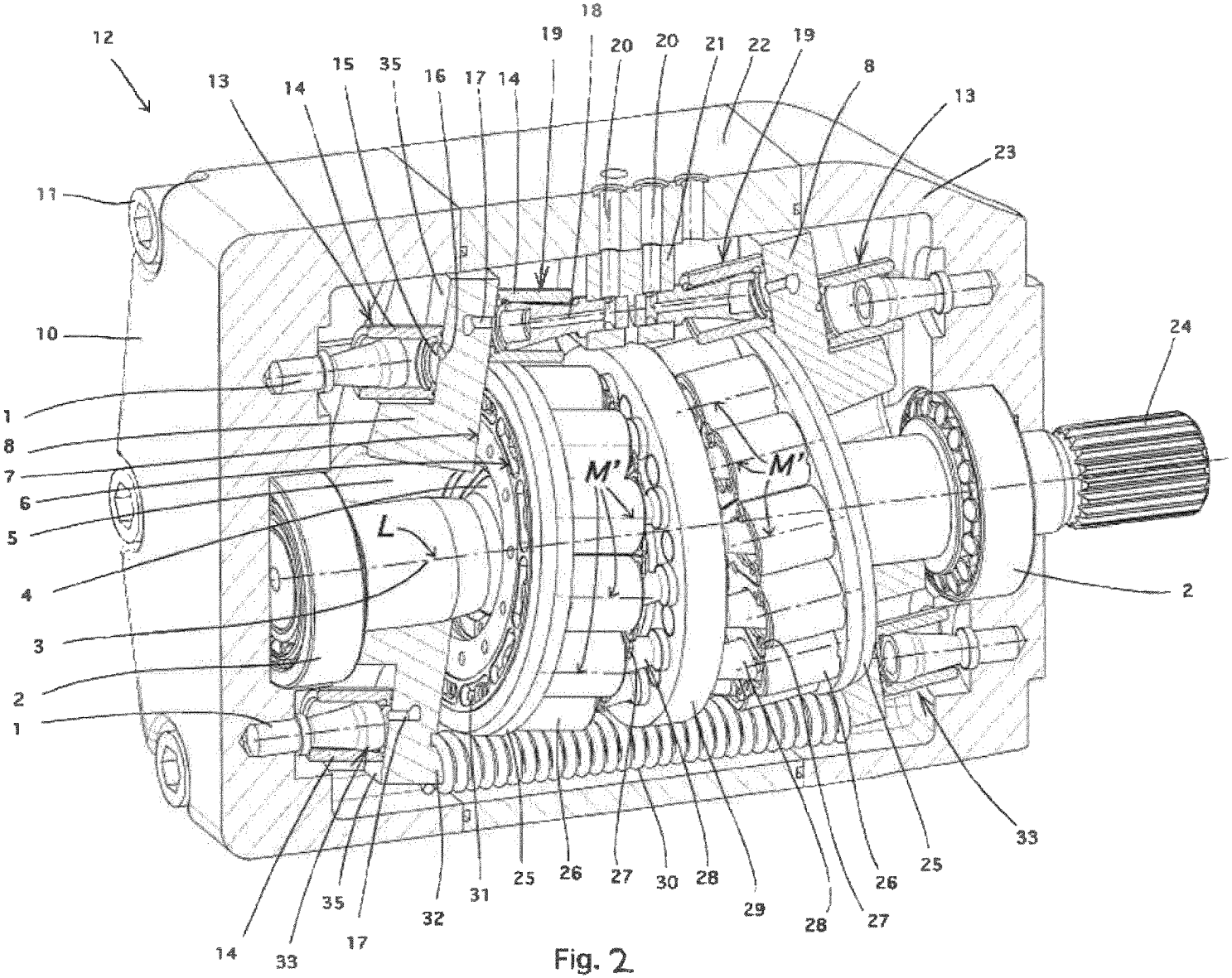
FIG. 2 is a cross-sectional view of an embodiment of a hydraulic pump.

FIG. 2 shows an embodiment of a hydraulic pump 12 which is provided with a hydraulic swash block positioning system according to the invention. A motor (not shown) drives the pump 12 via a splined shaft end 24. The pump 12 is connected with pressure lines (not shown in FIG. 2) and compresses oil of low-pressure to oil of high-pressure, from a low oil pressure source to a high oil pressure source.

The pump 12 comprises a housing 22 on which a first cover 10 and a second cover 23 are fastened with bolts 11, the first cover 10 and the second cover 23 have bearings 2 in which a shaft 3 can rotate around a first axis L. The shaft 3 sealingly extends through the second cover 23 and ends as the splined shaft end 24.

The shaft 3 has a flange 29 in the center of the housing 22 and pump plungers 28 extend on both sides of the flange 29, in this embodiment on both sides twelve pump plungers 28. The plungers 28 at one side of the flange 29 are positioned in between plungers 28 at the opposite side, thereby creating an out of phase operation. Pump cylinders 26 enclose the pump plungers 28 and rest against a channel plate 25. The pump plungers 28 have a spherical sealing surface that seals against the inside surface of the pump cylinder 26, so that the inside of the pump cylinder 26 forms a pump chamber with the pump plunger 28. During use, the pump cylinders 26 seal against the channel plate 25 under influence of the pressure in the pump chamber. In order to prevent that leakage occurs in situations where the pressure in the pump chamber is too low a spring 27 is provided, this spring 27 presses the pump cylinders 26 against the channel plate 25. In other embodiments instead or in addition to the spring 27 locking means hold the pump cylinder 26 against the channel plate 25, thereby maintaining the possibility of a sliding movement of the pump cylinder 26 over the channel plate 25.

An opening in the bottom of the pump cylinder 26 connects with a channel 31, which ends at a valve surface 6 of the channel plate 25. The valve surface 6 rotates over a swash block surface 7 of a swash block 8. The channel plate 25 rotates with the shaft 3 and is coupled with the shaft 3 by a sphere shaped coupling 4, so that it can swivel over the coupling 4 and rotate around a second axis M (not shown), which intersects the first axis L. The swash block 8 determines the tilt angle of the second axis M. The direction of center lines M' of the pump cylinders 26 is parallel to the second axis M, so that the sealing surface between a pump plunger 28 and a pump cylinder 26 is perpendicular to the second axis M and the center lines M'. The first cover 10 and the second cover 23 and the housing 22 have canals (not shown) that connect the pressure lines with the swash blocks 8 and so with the pump chambers. Due to the angle between the first axis L and the second axis M in a full rotation of the shaft 3 the volume of the pump chamber changes a stroke volume between a maximum volume and a minimum value. The stroke volume determines the pump displacement.

Figure 3:
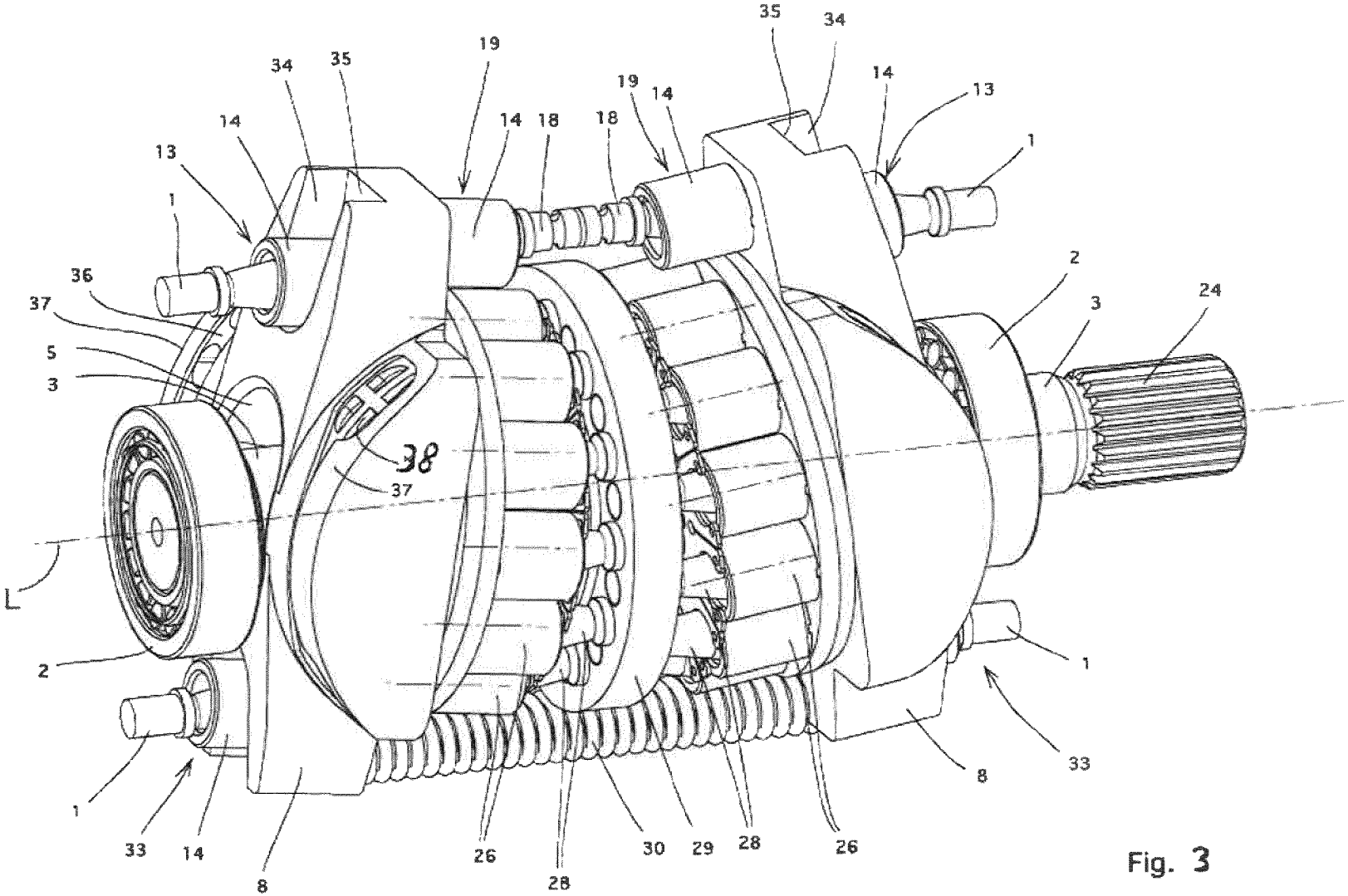
FIG. 3 is a perspective view of the interior of the hydraulic pump of FIG. 2.
Figure 6:
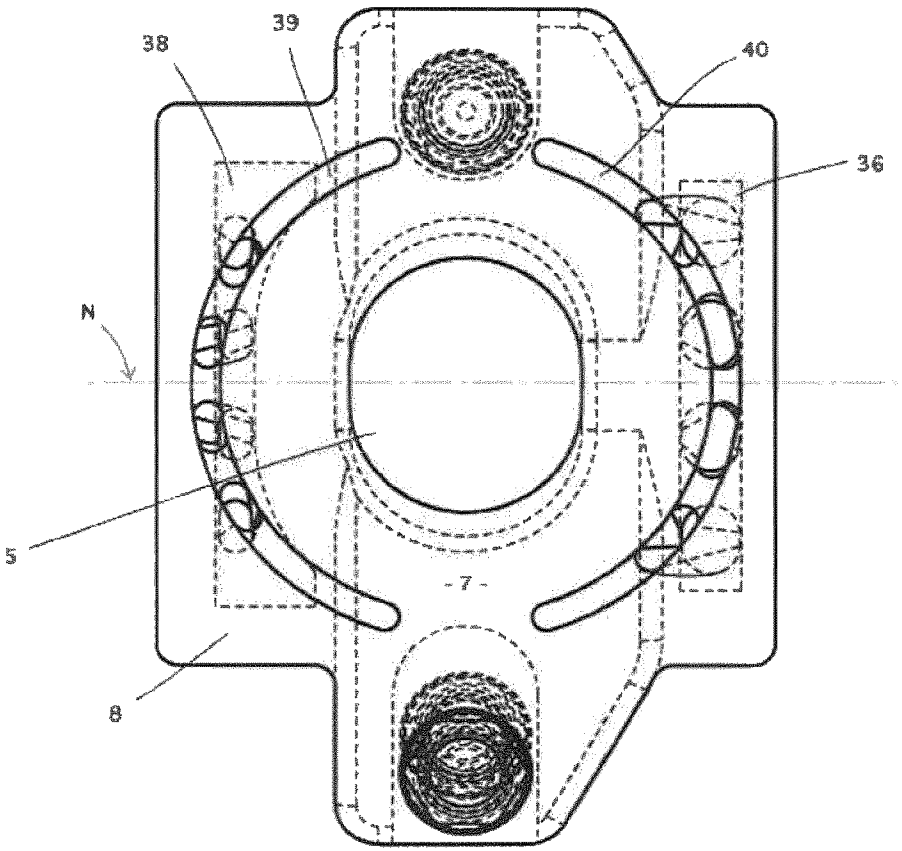
FIG. 6 is a frontal view of the swash block of FIG. 5.
Figure 5:
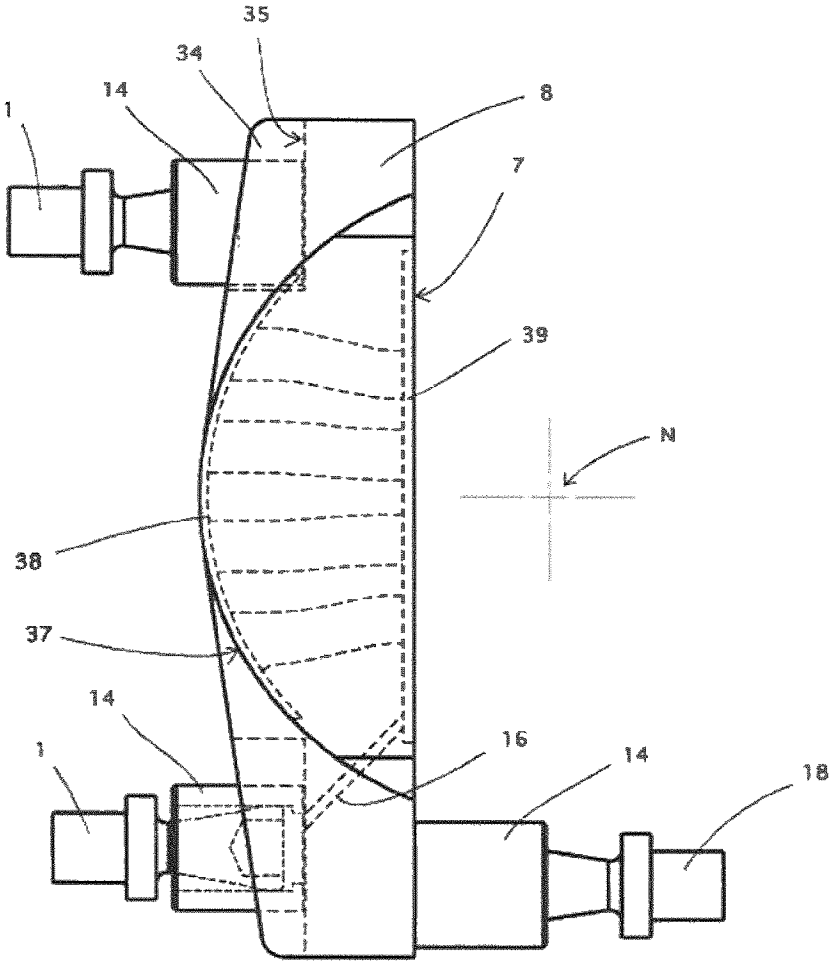
FIG. 5 is a side view of a swash block of the hydraulic device of FIG. 2.

By rotating the swash block 8 around a swash block axis N (see FIGS. 5 and 6), which is perpendicular to a center plane through the first axis L and second axis M and intersects these axes L and M, the angle between the first axis L and the second axis M is changed and with this also the stroke volume and displacement of the pump 12. A first actuator 33 and a third actuator 19 together form a positioning drive for setting the swash block angle and can rotate the swash block 8 in a first direction around the swash block axis. The first actuator 33 comprises a plunger 1 mounted in the first cover 10. A cylinder 14 is mounted around the plunger 1. To follow the rotation of the swash block 8 the underside of the cylinder 14 can slide over a slide surface 35 which is the bottom of a slot 34 in the swash block 8 (see FIG. 3). An actuator chamber of the first actuator 33, formed by the plunger 1 and the cylinder 14, is open at the bottom and connects with an interconnecting channel 17 in the swash block 8 to a similar actuator chamber of the third actuator 19. The third actuator 19 has a hollow plunger 18 mounted in a support 21 attached to the housing 22. A canal through this hollow plunger 18 is part of a feeding line 20 that is connected to a control unit, which is explained later. By increasing oil pressure in the feeding line 20, the first actuator 33 and the third actuator 19 rotate the swash block 8 towards a position with a reduced stroke volume.

A second actuator 13 forms a compensation drive and comprises a plunger 1 mounted in the first cover 10 and a cylinder 14 slidable over the slide surface 35. The actuator chamber is connected through the opening in the bottom of the cylinder 14 with a high pressure channel 16 in the swash block 8 that connects the actuator chamber with a high-pressure port 39 (see FIGS. 5 and 6). The high-pressure port 39 is connected to the pressure line with oil of high pressure. The second actuator 13 counter acts the torque that the pump cylinders 26 exert on the swash block since the counter torque cannot be created by a negative pressure at the first actuator 33 and the third actuator 19. Hence, the second actuator 13 basically creates a compensation torque.

When starting the pump 12 a spring 30 presses the swash blocks 8 in a tilted position. A spring support 32 positions the spring 30 on the swash block 8. In the tilted position, the stroke volume is maximal during starting.

In order to prevent leakage between the cylinders 14 and the swash block 8 the cylinders 14 are pressed by a spring (not shown) against the swash block 8. In another embodiment, there are (additional to or instead of the spring) locking means that hold the cylinders 14 slidingly against the swash block 8. After the pump 12 has started the pressure in the actuator chamber presses the cylinders 14 against the swash block 8.

FIGS. 3-6 show the interior of the pump 12 and the swash blocks 8. Each swash block 8 has in the swash block surface 7 a high-pressure port 39 and a low-pressure port 40, between these ports there is a crossover area 41. The other side of the swash block 8 has a cylindrical bearing surface 37 that rests in a cylindrical support surface (not shown) of the first cover 10 or the second cover 23. The swash block 8 can rotate in this cylindrical support surface around the swash block axis N. The cylindrical bearing surface 37 that lies opposite the high-pressure port 39 has a high-pressure canal 38 that connects in the swash block 8 with the high-pressure port 39. In the first cover 10 or the second cover 23 the high-pressure canal 38 continues to the high-pressure pressure line or a high oil pressure source. In the same way, the cylindrical bearing surface 37 that lies opposite the low-pressure port 40 has a low-pressure canal 36 that connects to the low-pressure pressure line or a low oil pressure source in the first cover 10 or the second cover 23.

During operation the high-pressure port 39 produces a high oil pressure between the swash block surface 7 and the valve surface 6 at the location of the high-pressure port 39 and a diminishing pressure in the surrounding seal land, that is the surrounding area of the high-pressure port 39 that works as a seal between the high pressure and a low-pressure inside of the pump 12. The high oil pressure causes a force on the swash block 8 that is more or less completely counteracted by force in the direction of the swash block surface 7 caused by the high pressure in the high-pressure canal 38 in the cylindrical bearing surface 37 and the surrounding seal land. This requirement determines the area of the high-pressure canal 38 in the cylindrical bearing surface 37.

The rotation of the pump cylinders 26 and the channels 31 cause in the crossover area 41 a pressure change when a channel 31 changes from the connection with the high-pressure port 39 to the low-pressure port 40 or vice versa. This fluctuating pressure causes a fluctuating force on the swash block 8 and causes fluctuating gaps between the swash block surface 7 and the valve surface 6, which leads to oil leakage that must be as little as possible as it reduces the efficiency of the pump 12. In order to reduce these gaps the first actuator 33 and the second actuator 13 exert forces on the swash block 8 in the direction of the swash block surface 7 and have a direction perpendicular to this surface. In this way, the forces of the actuators reduce the deformations of the swash block 8. The actuators work at a distance from the swash block axis N on the swash block 8, which is equal or larger than the radius of crossover area 41, which also reduces deformations of the swash block 8. Preferably, the positions of the actuators are such that the stroke of the plungers 1 and 18 in the cylinders 14 is equal or less than the stroke of the pump plungers 28 in the pump cylinders 26, so that the same parts can be used. This means that the distance of the actuators to the first axis L can maximal be twice the radius of the pump plungers 28 around the first axis L.

Placing the actuators at a distance from the swash block axis N that is greater than the radius of the pressure ports 39 and 40 has the additional advantage that the shaft 3 can extend through a hole in the swash block 8. It is then possible to place several pumps in line with each other whereby the shafts 3 are connected.

The disclosed embodiment shows two sets of pump plungers 28 each working with a swash block 8. This design has the advantage that a small angle between the first axis L and the second axis M obtains a pump of high capacity.

As described hereinbefore, the piston chambers are connected via the high pressure port 39 in the swash block 8 with the high oil pressure source or via the low-pressure port 40 in the swash block 8 with the low pressure source. The piston chambers that are connected with the high pressure port 39 and the piston chambers that are connected with the low pressure port 40 together exert a resultant force on the swash block 8. Due to the rotational movement of the shaft 3 the length of an arm between the swash block axis N and the location where the resultant force is exerted on the swash block 8 varies during rotation about the first axis L. This variation may be decreased with an increased number of piston chambers and/or an odd number of piston chambers.

Figure 4:
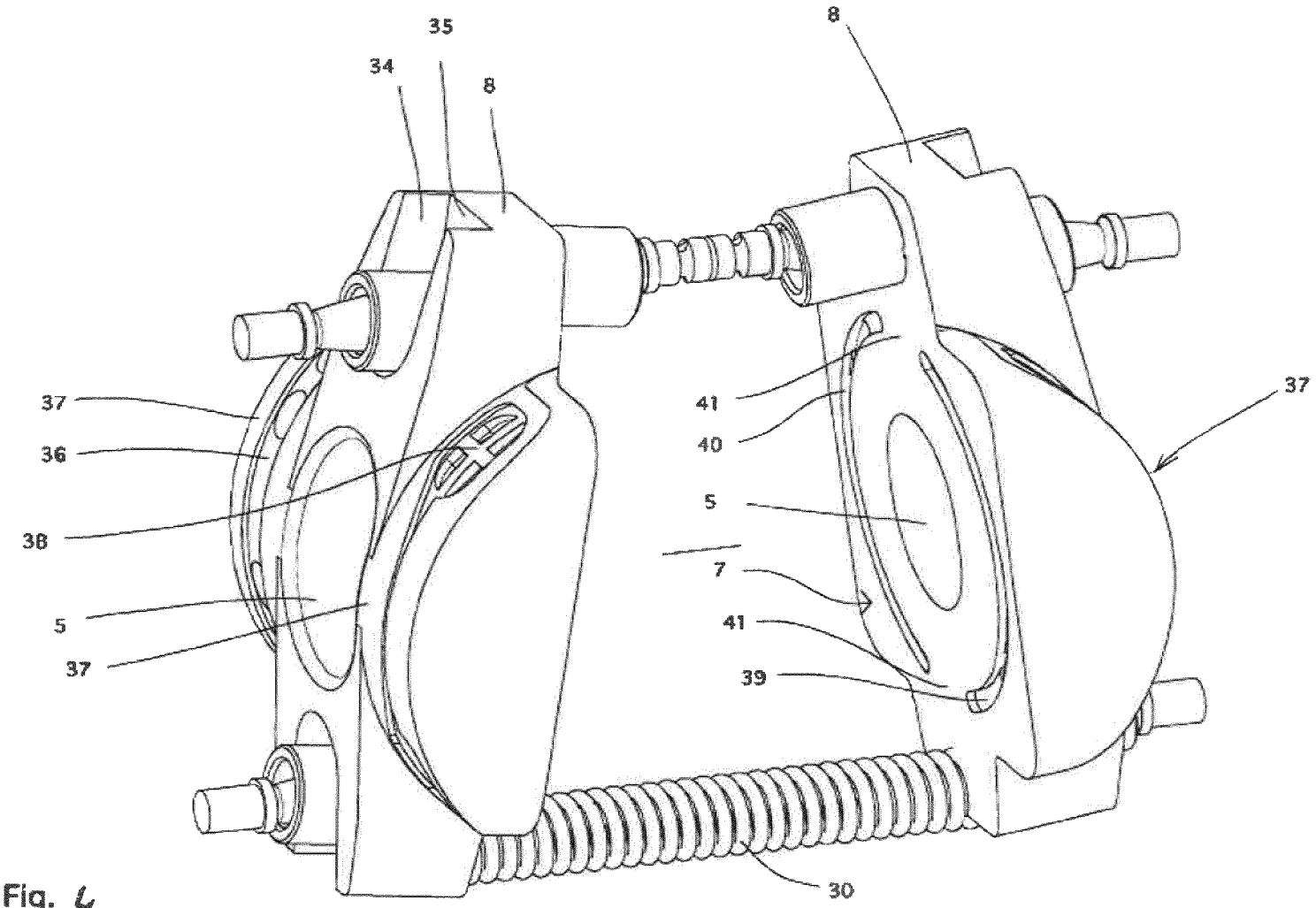
FIG. 4 is a perspective view of swash blocks and swash block drives of the hydraulic pump of FIG. 2.

Furthermore, when a piston chamber passes the crossover areas 41 between the high pressure port 39 and the low pressure port 40 the pressure in the passing piston chamber changes; the transition or crossover area 41 can be seen in FIG. 4. This influences the resultant force on the swash block 8 and the location where the resultant force acts on the swash block 8. In the embodiment of the pump 12 as shown in FIGS. 2-6 a piston chamber passes the crossover area 41 from the high pressure port 39 to the low pressure port 40 at the top dead center and a piston chamber passes the crossover area 41 from the low pressure port 40 to the high pressure port 39 at a bottom dead center at the same time. As a consequence, the extent and the location of the resultant force with respect to the swash block axis N will change during rotation of the shaft 3.

The varying resultant force on the swash block 8 creates a swivel torque on the swash block 8 around the swash block axis N that oscillates with an oscillation frequency that is equal to the number of the piston chambers that rotate along the swash block 8 times the number of full rotations of the shaft 3 per second.

As described hereinbefore in relation to a control system of a prior art pump with a single swash block as shown in FIG. 1, the oscillation of both swash blocks 8 of the pump 12 as shown in FIGS. 2-6 also leads to fluctuating compression and expansion of the oil volume in the first actuator 33 and the third actuator 19.

Figure 7:
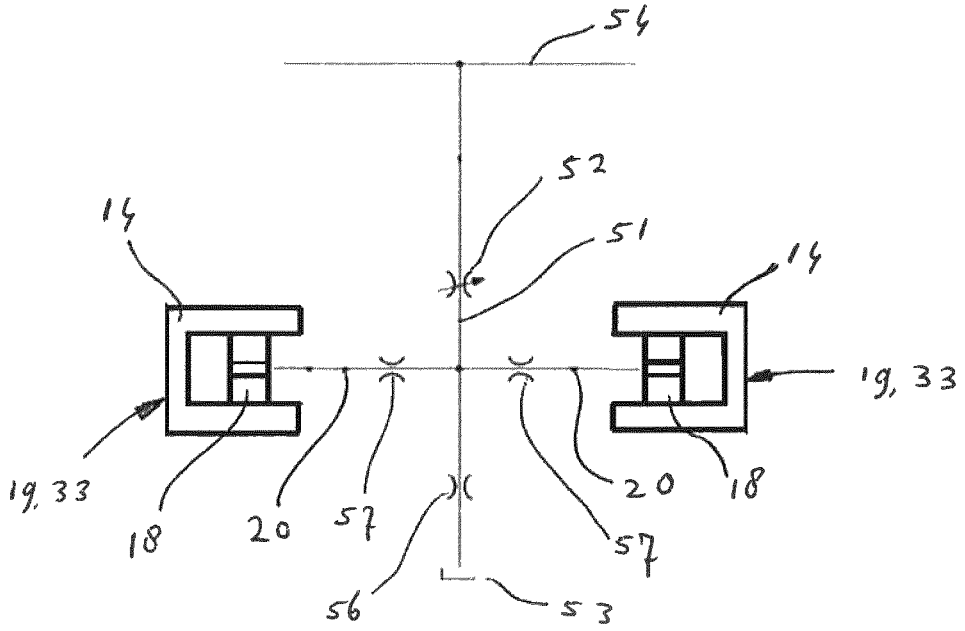
FIG. 7 is a schematic view of an embodiment of the hydraulic swash block positioning system for use in the pump of FIGS. 2-6 according to the invention.

FIG. 7 shows schematically a part of the positioning system for positioning the two swash blocks 8 of the pump 12; the positioning system can be adapted to be used for pumps with one swash block 8, as will be described later. The feeding lines 20 are connected to the hollow plungers 18 of the first and second actuators 33, 19. The feeding lines 20 are connected to a control flow line 51 via respective feeding line restrictions 57. The flow line 51 connects via a control valve 52 to a high oil pressure source 54, on the one hand, and to a low oil pressure source formed by a drain 53 via a downstream restriction 56, on the other hand. The control valve 52 can change the oil flow through the control flow line 51 and the downstream restriction 56 to the drain 53, hence dictating the oil pressure in the flow line 51 between the feeding line restrictions 57. The high oil pressure source 54 is connected to the high pressure canal 38 of the pump 12.

Due to the out of phase operation of the pump 12 the swash blocks 8 oscillate in counter phase causing the first and second actuators 33, 19 to oscillate in counter phase, as well. In other words, the swash block 8 of one side causes a pressure rise in the corresponding feeding line 20, whereas the swash block 8 of the opposite side causes a pressure drop in the corresponding feeding line 20. As a consequence, there is an oscillating oil flow between the actuators 33, 19 at the opposite sides of the flange 29 through the feeding lines 20 and the respective feeding line restrictions 57. In this oscillating oil flow there are no valves so that it follow the high oscillating frequency of the swash blocks 8.

Furthermore, the oil flow from the high pressure source 54 to the drain 53 through the control flow line 51 is relatively low as it is mainly required to refresh the oil volume oscillating between the actuators 33, 19 and/or in order to prevent heat build-up. This is advantageously in terms of efficiency. It is noted that under certain operating conditions and for instance depending on the rotation speed of the pump the oscillating oil flow between the actuators 19, 33 through the feeding lines 20 can be much higher than the oil flow from the high pressure source 54 to the drain 53 through the control flow line 51, for example 50-100 times but higher or lower ratios are conceivable, depending on the selection of the restrictions 56, 57. The positioning system reduces the risk of cavitation in the actuators 19, 33 and the corresponding feeding lines 20.

Figure 8:
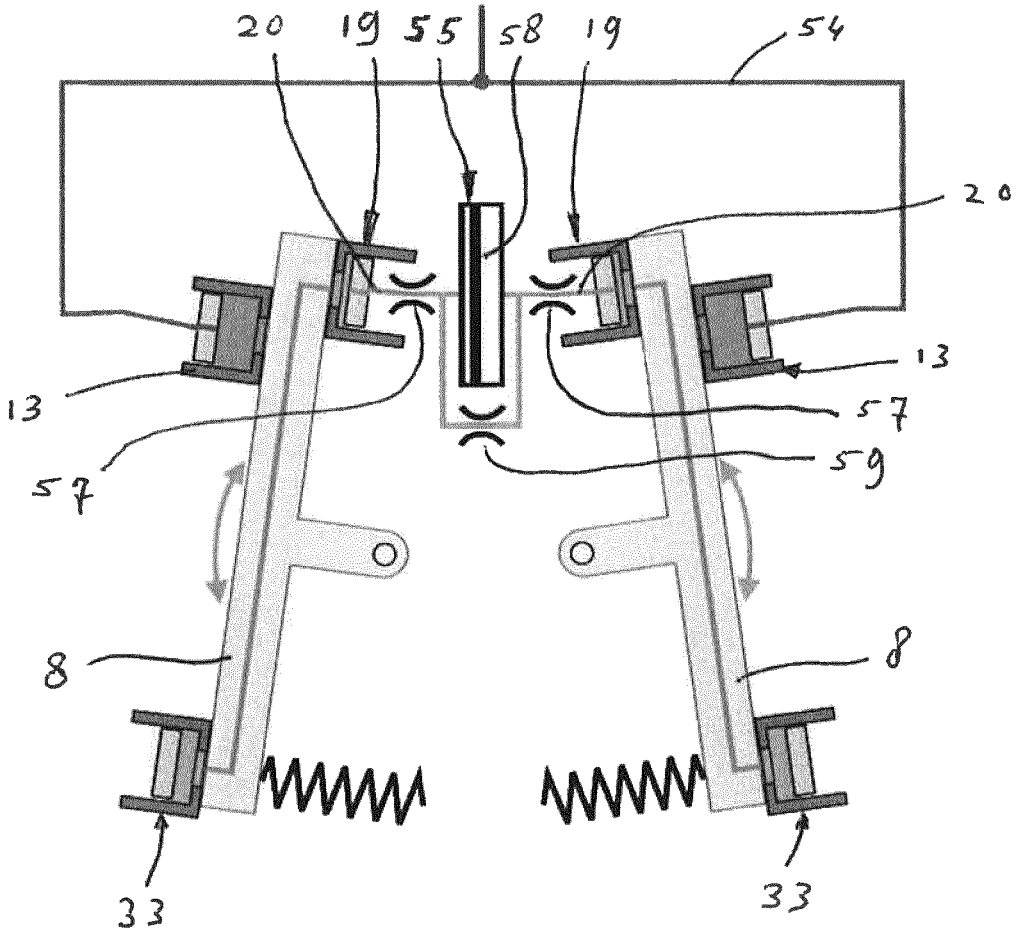
FIG. 8 is a schematic view of an alternative embodiment of the positioning system.

FIG. 8 shows a part of an alternative embodiment of the positioning system. In the shown embodiment the high oil pressure source 54 is connected to the second actuator 13 or compensation piston. The feeding lines 20 to the first and second actuators 33, 19 are connected via the feeding line restrictions 57 to flow limiter 55 which is provided with a movable separation wall 58. The separation wall 58 divides the flow limiter 55 in two volumes which are each connected to a feeding line 20. The separation wall 58 lets each volume in the flow limiter 55 vary between a minimum and a maximum value. Furthermore, a flow limiter restriction 59 is located in a canal that connects the two feeding lines 20. The flow resistance of the flow limiter restriction 59 may be different from the flow resistance of the feeding line restrictions 57. It is noted that for reasons of clarity FIG. 8 does not show the control valve.

The positioning system as illustrated in FIG. 8 may also be adapted to be used in a pump which has a single swash block 8. In that case the actuators 19, 33 of the single swash block are connected to the flow limiter 55 via the feeding line restriction 57, whereas the line in which the flow limiter restriction 59 is located ends at a pressure source that has an equal pressure to the average pressure in the feeding line 20. The separation wall 58 has a drive, that can be electrical or mechanical, and can be oscillated in counter phase with respect to the actuators 33, 19 such that a similar effect of fluctuating oil flow through the feeding line 20 is created as in the pump including two opposite swash blocks. A similar adaption can be made to the positioning system as shown in FIG. 7, whereby one of the pair of actuators 19, 33 is not connected to the second swash block of the pump but is replaced by an adjustable volume that is varied in counter phase at the oscillation frequency by external means.

Figure 9:
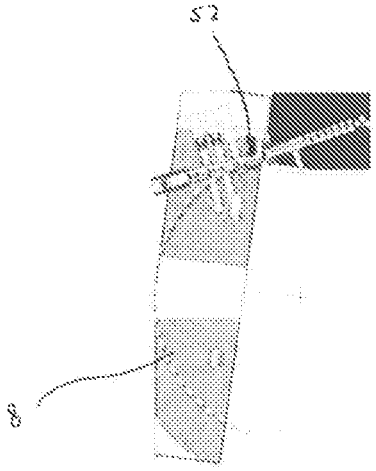
FIG. 9 is a cross-sectional view of a part of an embodiment of the pump which is provided with the positioning system of FIGS. 7 and 8, illustrating a control valve.

FIG. 9 shows a part of an embodiment of the pump 12 in which the control valve 52 is hydraulically actuated and mounted in the swash block 8. The figure shows the control valve 52 in a pump 12 with two swash blocks 8. It will be clear that the same design applies for hydraulic devices or pumps with one swash block.

Figure 10:
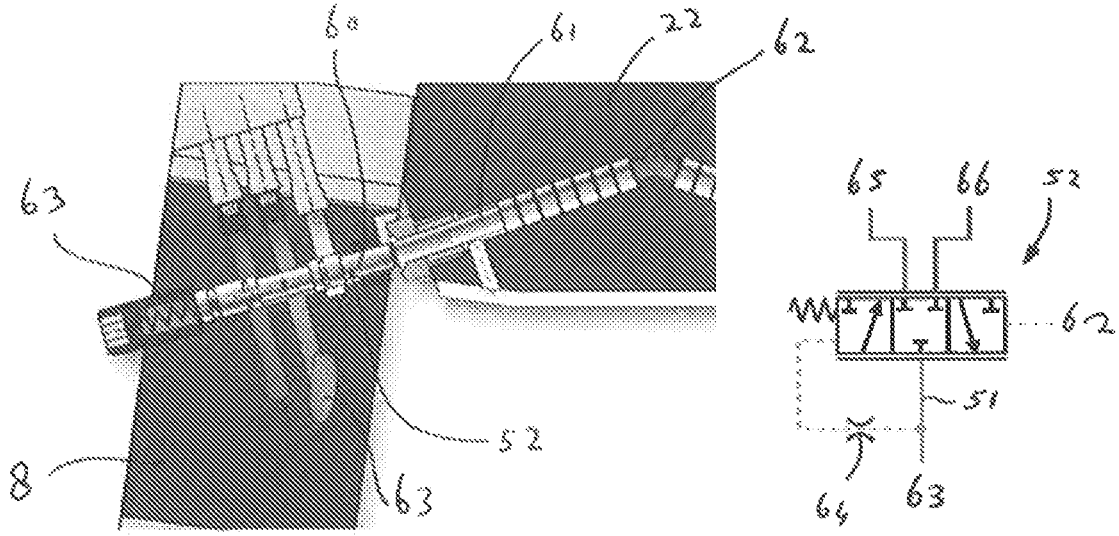
FIG. 10 is an enlarged view of a part of FIG. 9 and a corresponding hydraulic schematic symbol.
Figure 11:
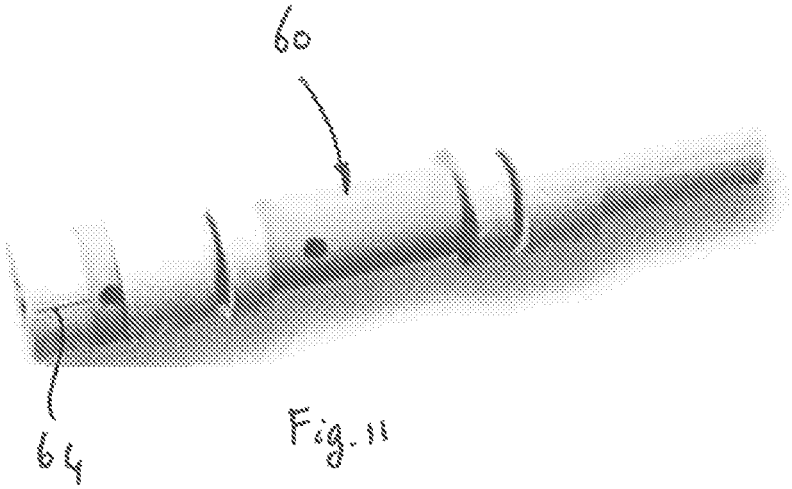
FIG. 11 is a perspective view of a servo spool used in the control valve of FIGS. 9-10.

FIG. 10 shows the control valve 52 on a larger scale and the corresponding hydraulic schematic symbol. The control valve 52 is a 3/3 servo valve and comprises a servo spool 60. An actuator pin 61 is provided in the housing 22 and is able to move the servo spool 60. FIG. 11 shows the servo spool 60 on a larger scale. One end of the actuator pin 61 ends in a cylinder that is connected to a control pressure 62 which is set by a control unit (not shown). One end of the servo spool 60 ends in a cylinder that is connected to the control flow line 51 through a servo spool restriction 64 that is located on the outside circumference of the spool surface to prevent clogging. The control valve 52 can adjust the amount of oil in the first actuator 33 and the third actuator 19 on the basis of a pressure difference between the control pressure 62 and the average pressure in the control flow line 51 which exert opposite forces on the respective opposite sides of the actuator pin 61 and the servo spool 60. FIG. 10 shows that the control flow line 51 can be selectively connected to a high pressure source 65 and a low pressure source 66.

Figure 12:
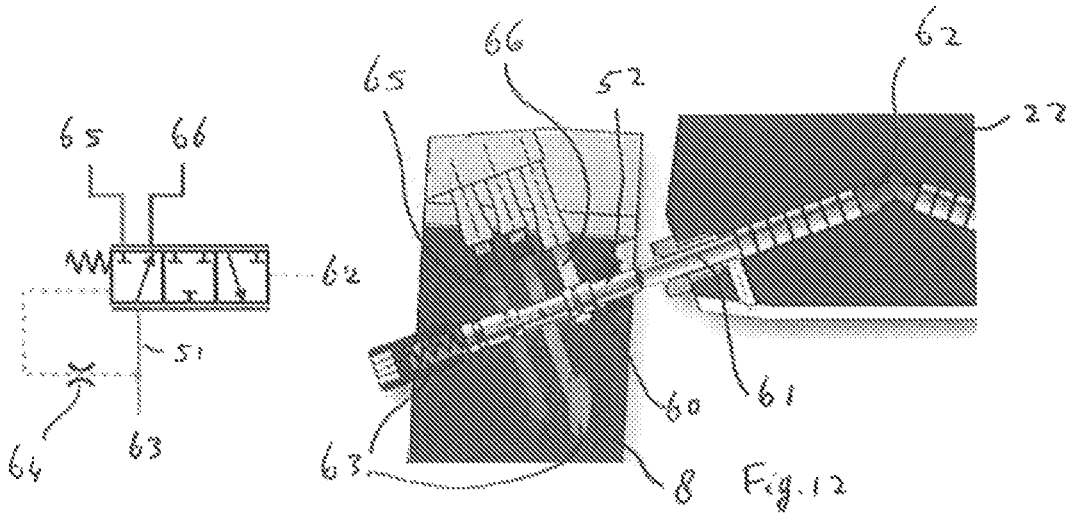
FIGS. 12-22 are similar views as FIG. 10, illustrating the functioning of the control valve.
Figure 13:
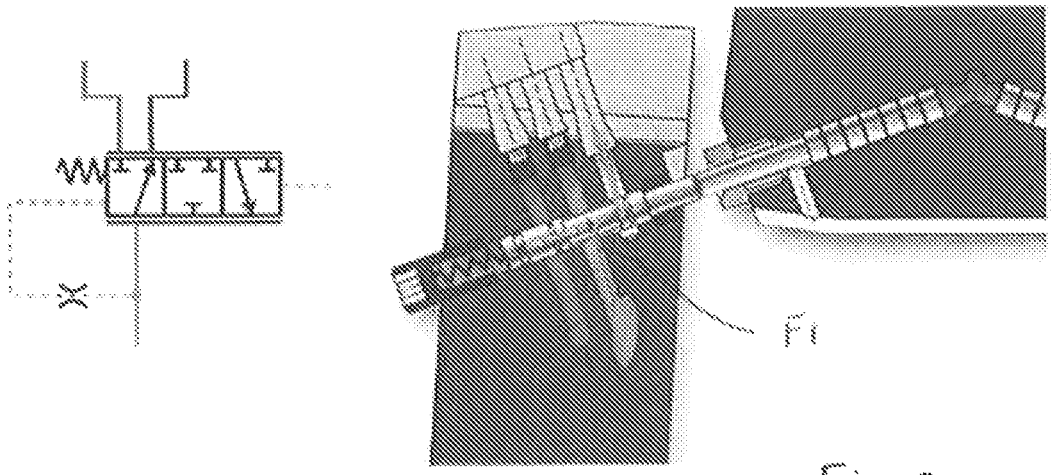
Figure 14:
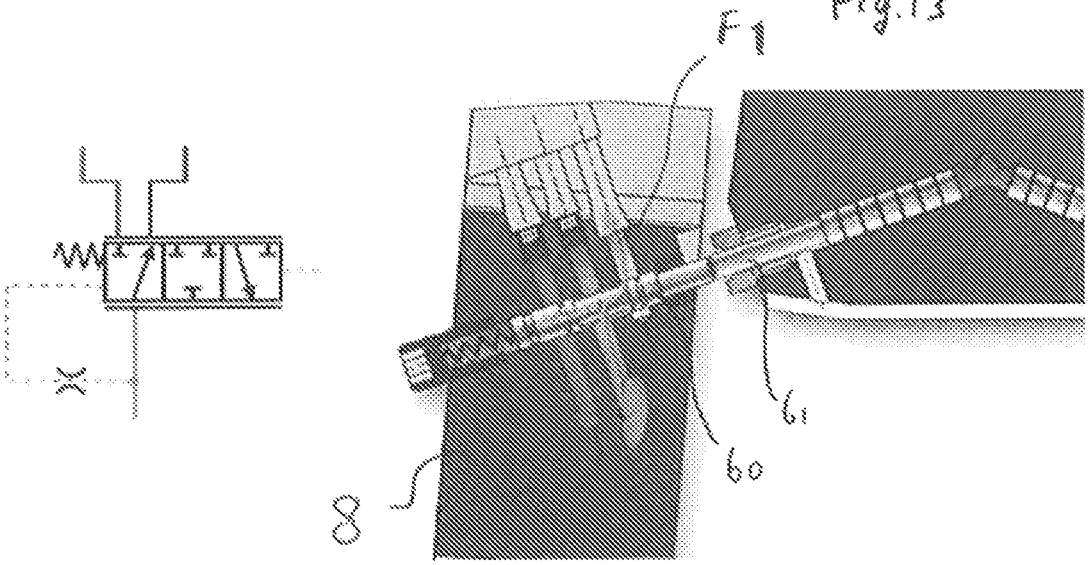
Figure 15:
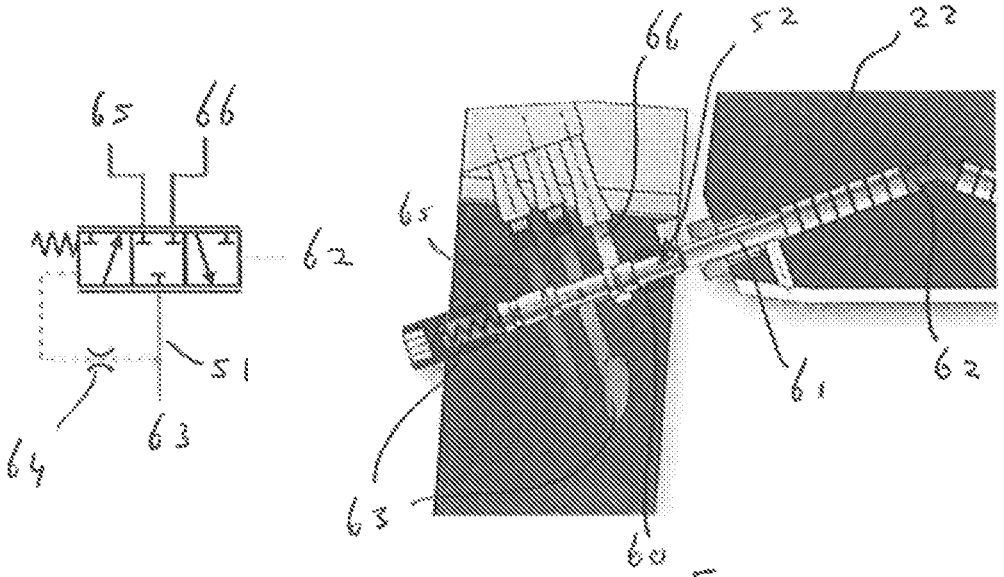

FIGS. 12-15 illustrate the functioning of the control valve 52 in case the swash blocks should be swiveled to a larger average swash block angle. FIG. 12 shows that in that case the control pressure 62 is lowered with respect to the actuator pressure 63 such that the servo spool 60 and the actuator pin 61 move to the right. The hydraulic schematic symbol of FIG. 12 illustrates that the control flow line 51 is connected to the low pressure source 66 in this condition, causing an oil flow from the control flow line 51 to the low pressure source 66. This flow is indicated by means of an arrow F1 in FIG. 13. Due to the resulting pressure drop in the control flow line 51 the amount of oil in the feeding line 20 and in the first actuator 33 and the third actuator 19 decreases such that the swash block 8 moves to a larger swash block angle, which can be seen in FIG. 14. This means a larger stroke volume causing a higher pump displacement. As soon as a desired pump displacement is reached, the control pressure 62 is increased by the control unit such that the actuator pin 61 and the servo spool 60 are moved to the left, see FIG. 15. In the new swash block angle the control valve 52 closes the control flow line 51 from the high pressure source 65 and the low pressure source 66.

Figure 16:
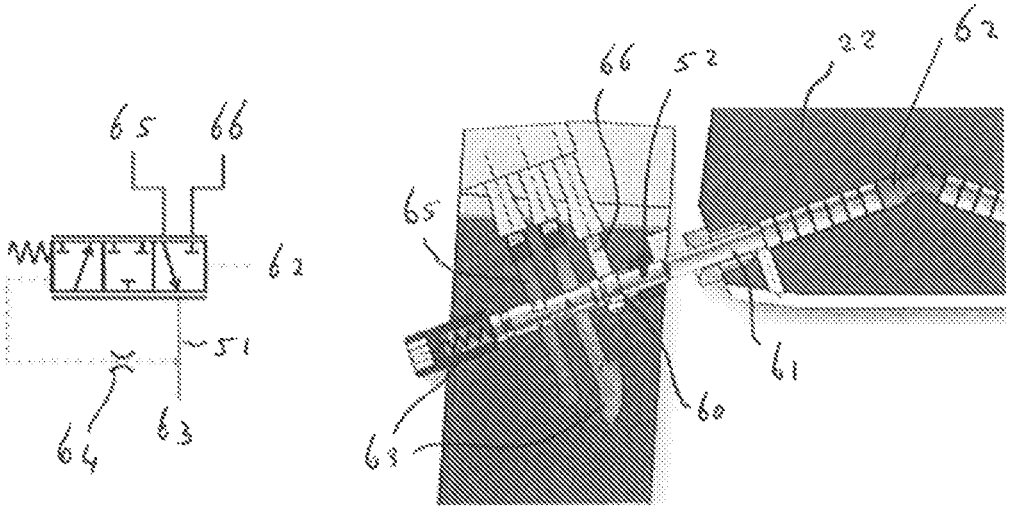
Figure 17:
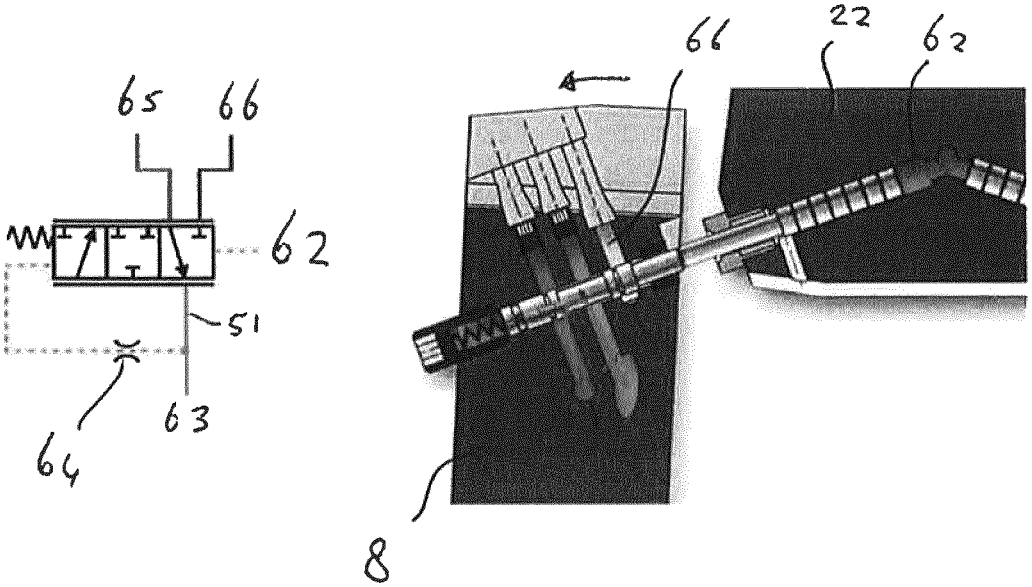

FIGS. 16 and 17 illustrate the functioning of the control valve 52 in case the swash block should be swiveled to a smaller swash block angle. FIG. 16 shows that the control pressure 62 is raised with respect to the average actuator pressure 63 such that the servo spool 60 and the actuator pin 61 are moved to the left. FIG. 16 also shows that oil flows from the high pressure source 65 to the control flow line 51. Due to the resulting increase of the oil quantity in the control flow line 51, in the feeding line 20 and in the first actuator 33 and the third actuator 19 the swash block 8 moves to a smaller swash block angle, which can be seen in FIG. 17. This corresponds to a smaller stroke volume causing a lower pump displacement. As soon as a desired pump pressure is reached, the control pressure 62 is lowered by the control unit such that the actuator pin 61 and the servo spool 60 are moved to the right, in which condition the control valve closes the control flow line 51 from the high pressure source 65 and the low pressure source 66. It is noted that the control unit controls the pump displacement using the control pressure 62 in order to obtain a desired setting of the pump in the controlled system. In the controlled system the hydraulic pressure, the pump capacity and/or the power used by the pump might determine the settings.

Figure 18:
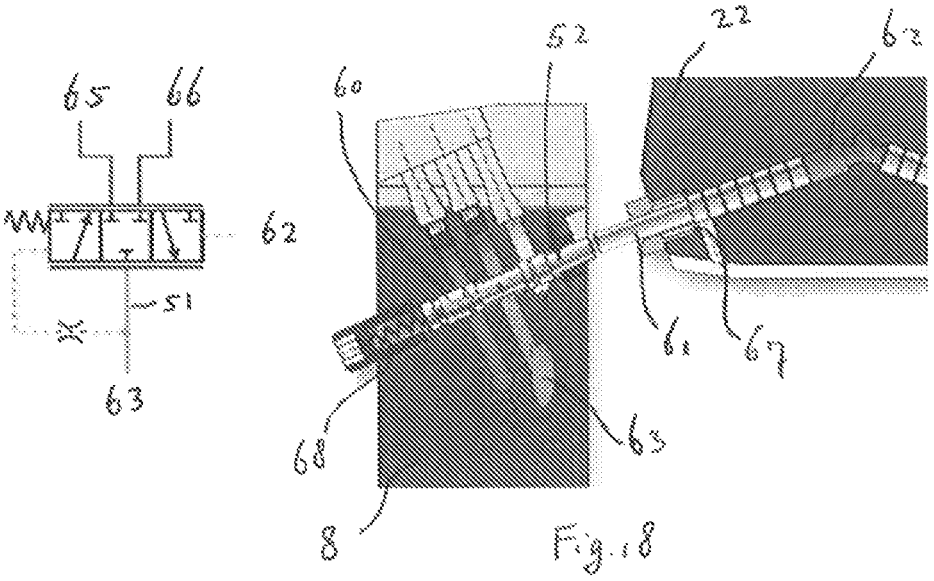
Figure 19:
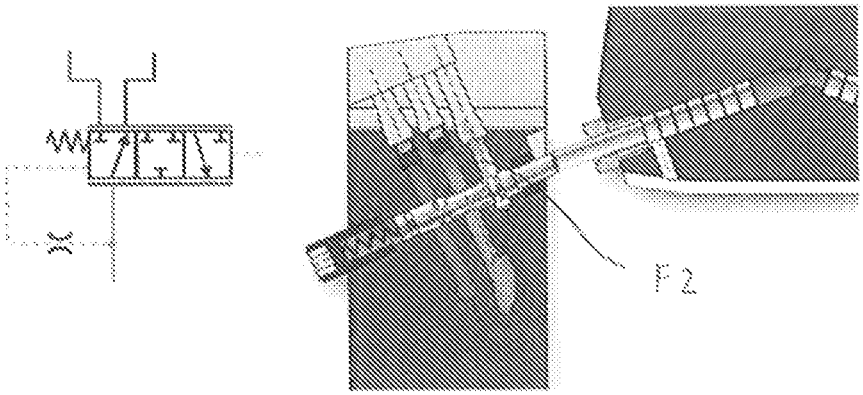
Figure 20:
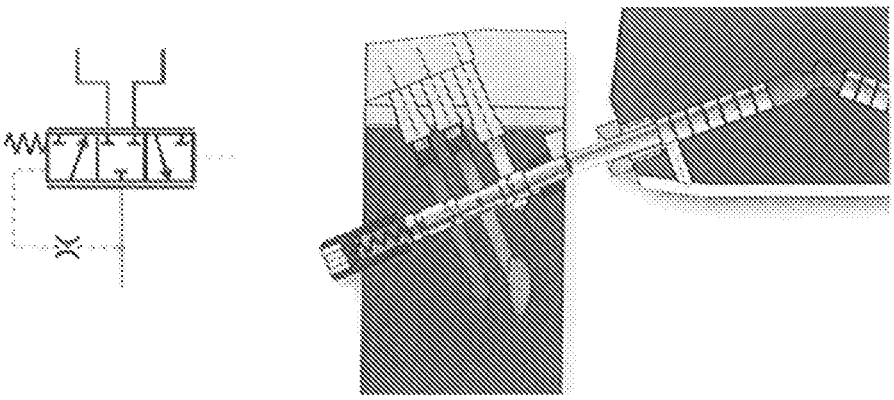

FIGS. 18-20 illustrate the functioning of the control valve 52 at a minimum swash block angle. FIG. 18 shows that the actuator pin 61 cannot move further outwardly with respect to the housing 22 because of the presence of an obstruction 67. A higher control pressure 62 would normally lead to a smaller swash block angle as explained hereinbefore, but this is not possible now because of the obstruction 67. If in this condition the swash block would swivel to a smaller angle, the servo spool 60 would be separated from the actuator pin 61, as illustrated in FIG. 18. In this condition the servo spool 60 will be moved to the right with respect to the swash block 8 by the actuator pressure 63 and/or a spring 68 located at the end of the servo spool 60. The control flow line 51 is then connected to the low pressure source 66, causing an oil flow from the control flow line 51 to the low pressure source 66. This is indicated by means of an arrow F2 in FIG. 19. Consequently, the swash block 8 moves to a larger swash block angle, whereas the servo spool 60 will travel with the swash block to the right until it hits the actuator pin 61. The servo spool 60 will be displaced to the left with respect to the swash block 8 such that the valve 52 closes the control flow line 51 from the high pressure source 65 and the low pressure source 66.

Figure 21:
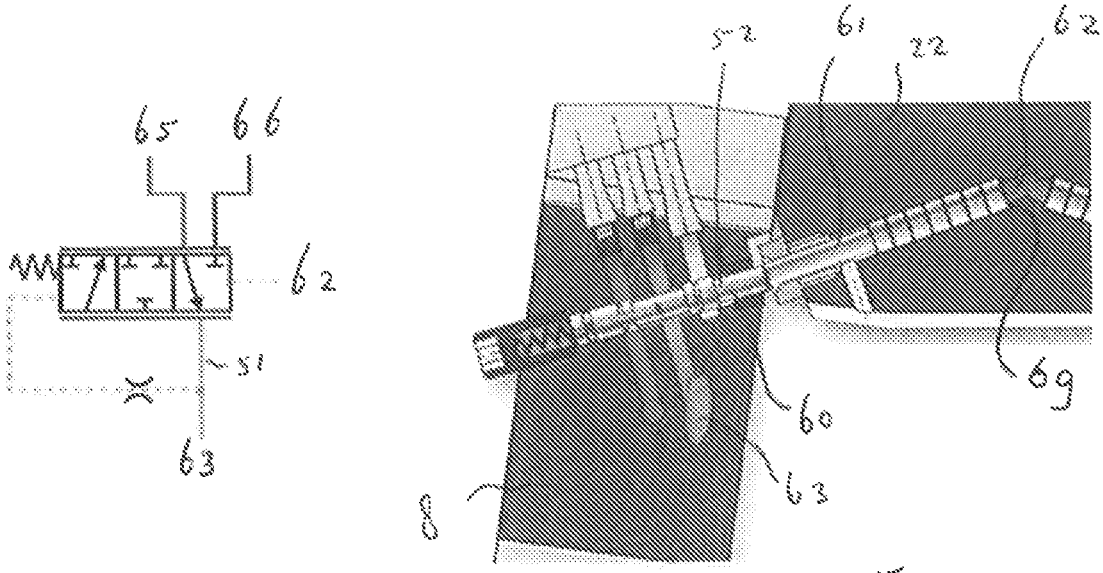
Figure 22:
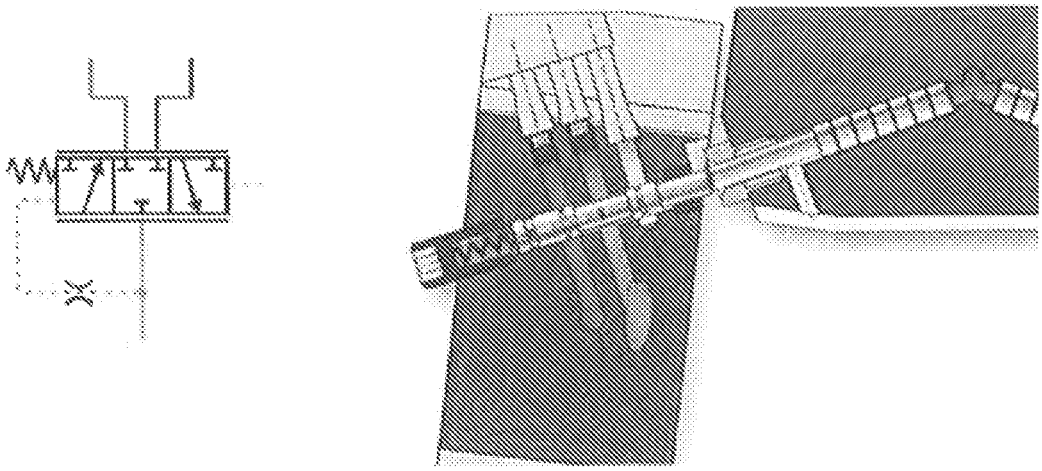

FIGS. 21 and 22 illustrate the functioning of the control valve 52 at a maximum swash block angle. FIG. 21 shows that the actuator pin 61 cannot move further inwardly with respect to the housing 22 because of the presence of an obstruction 69. A lower control pressure 62 would normally lead to a smaller swash block angle as explained hereinbefore, but this is not possible now because of the obstruction 69. If in this condition the swash block would still swivel to a larger angle, the servo spool 60 would be displaced to the left with respect to the swash block 8 due to hitting the actuator pin 61. This is illustrated in FIG. 21. The control flow line 51 is then connected to the high pressure source 65, causing the swash block 8 to move to a smaller swash block angle. Then the actuator pressure 63 will force the servo spool 60 to the right with respect to the swash block 8 such that the valve 52 closes the control flow line 51 from the high pressure source 65 and the low pressure source 66, see FIG. 22. This means that the control system has a hydraulically controlled maximum swash block angle and does not require a mechanical stop between the swash block 8 and the housing 22.

Figure 23:
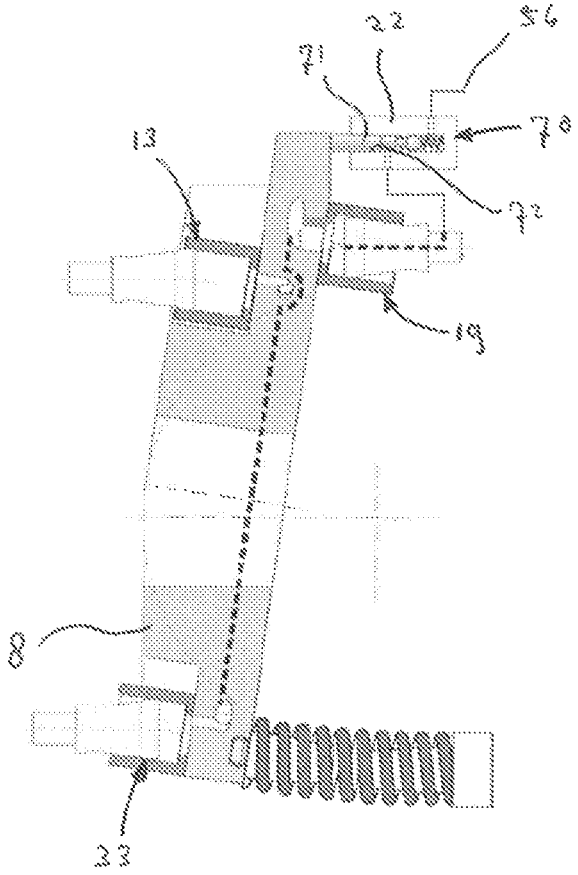
FIGS. 23 and 24 are illustrative views of alternative control systems for controlling the maximum and the minimum angle of the swash block, respectively.
Figure 24:
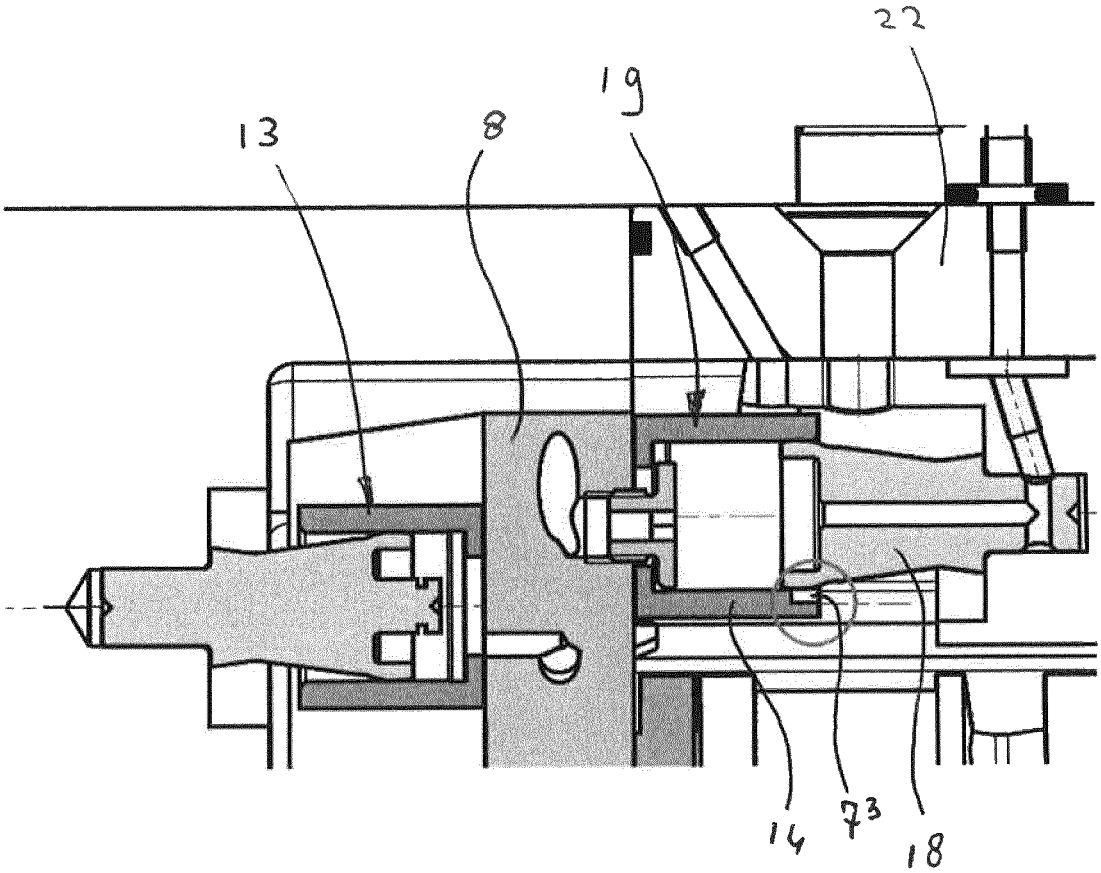

FIGS. 23 and 24 illustrate alternative control systems for controlling the maximum and minimum angle of the swash block 8, respectively. FIG. 23 shows a maximum displacement valve 70 including a valve plunger 71 which is movable in a cylinder 72 of the housing 22 of the pump 12. The valve plunger 71 is coupled to the swash block 8 and moves within the cylinder 72 when the swash block 8 rotates. If the swash block 8 tends to rotate beyond its predefined maximum angle the maximum displacement valve 70 will open. As a consequence, the first and second actuators 33, 19 are connected to the high oil pressure source 54 resulting in a reduction of the swash block angle. The predefined maximum angle can be varied by changing the length of the valve plunger 71.

FIG. 24 shows a part of an embodiment of an alternative pump 22 in cross-section. It can be seen that the cylinder 14 of the third actuator 19 is provided with a recess 73 which is located remote from the swash block 8 at an axial end portion of the internal wall of the cylinder 14. The recess 73 is located such that at a predefined minimum angle of the swash block 8 a small leakage is created between the cylinder 14 and the plunger 18. As a consequence, if the swash block 8 tends to rotate to a smaller angle oil will flow away via the recess 73 from the third actuator 19 and the pressure at the third actuator 19, and also of the first actuator 33 due to their internal connection, will decrease. Then the second actuator 13 will push the swash block 8 to a larger angle. This configuration creates an automatic minimum angle control.

In a further embodiment of the invention the swash block positioning system is used for setting the face plate in the hydraulic device as described in WO2012050446, of which the description is herewith included in the application. The face plate in this embodiment rotates around two rotation axes and as described in the document the design can be such that these two rotations are coupled and the setting of the face plate is controlled by a single hydraulic actuator. The face plate of the hydraulic device described in WO2012050446 is also subjected to a resultant force of the piston chambers that oscillates during rotation of the piston chambers in location and force. This leads to an oscillating load on the hydraulic actuator and the embodiment of the invention prevents cavitations in the hydraulic actuator.

The invention claimed is:

1. A hydraulic swash block positioning system for positioning a swash block that rotates around a swash block axis to a swash block position in a housing of a hydraulic device to set a variable displacement, the hydraulic device comprising a rotor with pistons and piston chambers, each piston chamber having a variable volume that, during rotor rotation, alternately connects to a high oil pressure source and to a low oil pressure source, the positioning system comprising:

a positioning cylinder with a positioning piston, the positioning cylinder and positioning piston collectively forming a positioning chamber, and the positioning chamber being operable to set an average value of the swash block position at a certain intermediate position between a minimum swash block angle and a maximum swash block angle such that the swash block oscillates about the average value under operation conditions;

a control valve connecting the high oil pressure source with the positioning chamber through a feeding line, wherein the feeding line is also fluidly connected to an oil container that has a variable container volume such that the positioning chamber and the oil container are continuously fluid communication with each other at all times during operation; and the oil container having an adjuster operable to adjust the oil container variable container volume in counter phase to a volume of the positioning chamber at a frequency that is equal to the number of piston chambers that rotate along the swash block times the number of full rotations of the rotor per second.

2. The hydraulic swash block positioning system in accordance with claim 1 wherein there are two swash blocks with synchronously rotating piston chambers, wherein during rotor rotation, a piston chamber of the first swash block and a piston chamber of the second swash block alternatingly connect to the high oil pressure source and wherein the positioning chamber comprises a first positioning chamber of the first swash block and a a second positioning chamber of the second swash block, and wherein the feeding line connects the first positioning chamber with the second positioning chamber.

3. The hydraulic swash block positioning system in accordance with claim 2, wherein the piston chambers that cooperate with the first swash block and the second swash block are mounted on a combined rotor between the swash blocks.

4. The hydraulic swash block positioning system in accordance with claim 3, wherein the first and second swash blocks are symmetric relative to a plane perpendicular to a rotor rotation axis.

5. The hydraulic swash block positioning system in accordance with claim 2, wherein the first positioning chamber connects via a first feeding line having a first flow restriction to a first side of a flow limiter with a movable separation wall and the second positioning chamber connects via a second feeding line having a second flow restriction to the flow limiter at a second side of the movable separation wall, wherein a line with a flow limiter restriction connects the first feeding line and the second feeding line.

6. The hydraulic swash block positioning system in accordance with claim 1, wherein a control flow line connects the control valve to the feeding line and to the low oil pressure source via a downstream restriction.

7. The hydraulic swash block positioning system according to claim 1 wherein the control valve is a hydraulic servo valve with a spool controlled by the average oil pressure in the positioning chamber and a control pressure depending on a desired change in the average value of the swash block position.

8. The hydraulic swash block positioning system in accordance with claim 7 wherein the control pressure acts on an actuator pin with a limited stroke that pushes against the spool, and wherein the spool is mounted in the swash block and the actuator pin in the housing or vice versa.

9. The hydraulic swash block positioning system in accordance with claim 1, wherein the adjuster operable to adjust the variable container volume varies the volume of the oil container proportionally to an actual oil pressure in the positioning chamber.

10. The hydraulic swash block positioning system in accordance with claim 1, wherein a maximum displacement valve has a sensor that detects when the swash block is approaching a first predefined swash block position and the maximum displacement valve connects the positioning chamber to the low oil pressure source or the high oil pressure source upon reaching the predefined swash block position.

11. The hydraulic swash block positioning system in accordance with claim 1, wherein the positioning cylinder is provided with a spill opening which opens upon reaching a second predefined swash block position so as to create a second limit for the swash block position.

12. The hydraulic swash block positioning system in accordance with claim 11, wherein the positioning cylinder is mounted on the swash block around the positioning piston, wherein the spill opening is formed by a recess which is located remote from the swash block at an axial end portion of an internal wall of the positioning cylinder.

13. The hydraulic swash block positioning system in accordance with claim 1, wherein the feeding line has a flow restriction between the positioning chamber and the oil container.

* * * * *